US008210353B2

(12) United States Patent
Epicureo

(10) Patent No.: US 8,210,353 B2
(45) Date of Patent: Jul. 3, 2012

(54) VACUUM STORAGE SLIPCOVER AND STORAGE AND/OR TRANSPORT BAG INTEGRATING SUCH A SLIPCOVER

(75) Inventor: Giulio Epicureo, Lille (FR)

(73) Assignee: Cie Europe S.A.S., Lomme (FR)

( * ) Notice: Subject to any disclaimer, the term of this patent is extended or adjusted under 35 U.S.C. 154(b) by 0 days.

(21) Appl. No.: 13/062,143

(22) PCT Filed: Aug. 12, 2009

(86) PCT No.: PCT/FR2009/051585

§ 371 (c)(1),
(2), (4) Date: Mar. 3, 2011

(87) PCT Pub. No.: WO2010/026329

PCT Pub. Date: Mar. 11, 2010

(65) Prior Publication Data

US 2011/0162995 A1 Jul. 7, 2011

(30) Foreign Application Priority Data

Sep. 5, 2008 (FR) ..... 08 55988

(51) Int. Cl.
*B65D 85/20* (2006.01)

(52) U.S. Cl. ..... 206/524.8; 220/495.06; 383/121.1; 206/577

(58) Field of Classification Search ..... 206/524.8, 206/223, 576, 577; 220/495.06; 383/100, 383/103, 121, 121.1; 190/100, 107
See application file for complete search history.

(56) References Cited

U.S. PATENT DOCUMENTS

| | | | | |
|---|---|---|---|---|
| 6,499,574 | B1 * | 12/2002 | Anthony | 190/36 |
| 7,674,041 | B2 * | 3/2010 | Frayne | 383/101 |
| 2005/0173439 | A1 * | 8/2005 | Chen | 220/495.06 |
| 2006/0120631 | A1 | 6/2006 | Tang | |
| 2009/0080809 | A1 * | 3/2009 | Pham et al. | 383/37 |
| 2011/0094930 | A1 * | 4/2011 | Piazza et al. | 206/524.8 |

FOREIGN PATENT DOCUMENTS

| | | |
|---|---|---|
| FR | 2 894 939 A | 6/2007 |
| FR | 2 912 997 A | 8/2008 |

* cited by examiner

*Primary Examiner* — Jacob K Ackun
(74) *Attorney, Agent, or Firm* — Kenyon & Kenyon LLP

(57) ABSTRACT

It is the object of the present invention to provide a storage slipcover for at least one article, especially textile articles, comprising a first envelope extending vertically and fitted at its upper end with an opening for insertion of said at least one article, and a plate fitted with folding means for the formation of a parallelepiped base in which is placed at least the lower part of the first envelope, said storage slipcover further comprising a second envelope assembled horizontally below the lower end of the first envelope, this second envelope comprising dimensions slightly greater than the plate, and at least one opening for introducing this plate in said second envelope.

16 Claims, 4 Drawing Sheets

VACUUM STORAGE SLIPCOVER AND STORAGE AND/OR TRANSPORT BAG INTEGRATING SUCH A SLIPCOVER

This is a 371 national phase application of PCT/FR2009/051585 filed 12 Aug. 2009, claiming priority to French Patent Application No. 0855988filed 05 Sept. 2008, the contents of which are incorporated herein by reference.

BACKGROUND OF THE INVENTION

The present invention relates to the field of storage facilities, specially adapted for the storage, and eventually the transport of at least one article in a suitcase.

The cost of real estate and the growing price of a square meter of living space involve novel problems with respect to bulk and storage means.

By way of example, numerous furniture-storing companies have sprung up, and most often are asking prohibitive prices proportional to the volume to be stored.

Similarly, the development of different means of transport, work flexibility and weekend arrangements bought over the Internet at the last minute imply a growing need in the area of baggage.

Yet, airline companies very often tax the bulkiness of each item of baggage as vehicle boots are offering less and less space for fitting in several baggage items.

More generally, it is evident that conventional baggage, and more globally, storage means inevitably do not suit the needs of people who want to store bulky items or of travellers, nor the volumes transported.

This problem of storage and transport resurfaces identically in the area of wholesale distribution and freight: where articles or merchandise must be compacted for bulk and cost reasons, then transported.

As is known, there are vacuum transport slipcovers which permit articles to be compressed by producing the vacuum in the slipcover.

There are also suitcases which integrate this type of slipcover to protect and transport them, or even store them provisionally.

This type of slipcover is particularly adapted to seasonal textile items.

According especially to the document US 2005/0173439, current slipcovers have an envelope for containing textile articles.

This envelope mainly comprises a valve for extracting air contained inside the latter, which compresses the articles contained in the envelope.

Also, according to the known prior art, said envelope comprises at its lower end a plastic film extending substantially in a plan perpendicular to the vertical envelope, the plastic sheet being attached to a plate of corresponding dimensions, the latter being especially made of cardboard and optionally covered in fabric. Assembling the plate with the film is done especially by stitching.

This plate made of cardboard extends longitudinally and comprises at its ends folds which form, during compression of the articles, a basic parallelepiped in shape.

The compressed articles thus take the form of a parallelepiped.

However, since the plastic film and the soft-board plate work differently during shaping of the parallelepiped, the drawback to such a conception is that the plastic sheet tears off at the level of its attachment points with the plate.

There are also slipcovers, especially according to the document US 2006/0120631, in which the soft-board plate is placed directly in the base of the slipcover.

This type of slipcover has some disadvantages.

Especially in the case of improper positioning of the plate, after the slipcover has been filled and vacuum-packed, it is necessary to open this slipcover, decompress it, take out the article, and then appropriately reposition the plate.

OBJECT AND SUMMARY OF THE INVENTION

An object of the invention is to attempt to rectify the above disadvantages, and also to reduce manufacturing costs of a storage slipcover.

To this effect, the invention provides a storage slipcover for at least one article, which can be for example a textile article.

The storage slipcover of the present invention comprises, on the one hand, a first envelope extending upwards, and which is fitted at its upper end with an opening for insertion of the articles.

The storage slipcover of the present invention comprises, on the other hand, a plate fitted with folding means for the formation of a parallelepiped base in which is placed at least the lower part of the first envelope.

This storage slipcover further comprises a second envelope which is assembled horizontally below the lower end of the first envelope.

It is evident that this second envelope has dimensions slightly greater than the plate, and that it comprises at least one opening in the second envelope for introducing the plate.

This design of the second envelope thus avoids the plate having to be fixed or assembled to the rest of the slipcover.

More particularly, it is evident that the arrangement between the second envelope and the plate allows the elements to operate independently of one another, and thus avoids the plate and/or the second envelope from tearing away.

Advantageously, the first envelope comprises at its upper end closing means for the opening, which can be for example a zipper system. These closing means allow an airtight seal for the slipcover.

In a preferred embodiment of the invention, the first envelope comprises on one of its walls air extraction means, which can for example be a valve. These extraction means enable extraction of air contained inside said first envelope.

It is therefore evident that the hermetic closing means and the air extraction means cooperate for the purpose of compressing the article(s) contained in the first envelope.

These means thus make it easy to store away the article(s) in the first envelope, while limiting their bulk.

In a particular embodiment of the invention, the second envelope, the lower part of the first envelope and the plate are rectangular in shape.

More particularly, the width of the plate is less than the width of the second envelope and than the width of the lower part of the first envelope. The length of the plate is less than the length of the second envelope and than the width of the lower part of the first envelope.

The plate can comprise two folding lines extending transversally, and separating this plate into a central part and two fold-down lateral parts to form the parallelepiped base, the central part being of a length slightly greater than the length of the first envelope in the compressed state, that is, air extraction is carried out.

In a variant embodiment of the invention, the second envelope comprises two lateral ends each fitted with an opening for the insertion of the plate.

In a variant of a particular embodiment described hereinabove, the two fold-down lateral parts are of identical length and size such that the volume of the parallelepiped base corresponds to the volume of the first envelope once the air is extracted.

Correlatively, it is a further object of the invention to provide a bag for storage and/or transport of articles.

More specifically, this storage bag is constituted by a container corresponding to an external slipcover, especially in the shape of a suitcase, and a storage slipcover according to one of the embodiments described hereinabove; this storage slipcover is suitable to be enclosed in said container.

According to a variant of the present invention, the container comprises a peripheral vertical wall. On its internal face this wall comprises reception means for receiving the parallelepiped base for stabilisation of the slipcover in the container.

In a particular variant embodiment, the peripheral vertical wall comprises at least two lateral sides, and the reception means are constituted by rebates located at the level of the upper angular ends of these two lateral sides.

These rebates can thus receive the angular ends of the fold-down lateral parts of the plate during formation of the parallelepiped base.

Finally, the subject matter of the invention will relate to a kit constituted both by a bag, comprising a storage slipcover, and also by a pumping apparatus which enables extraction of air in the slipcover. This pumping apparatus is preferably a travel pump or a mini-fan which can, for example, be placed in the container once the storage slipcover is compressed.

BRIEF DESCRIPTION OF THE FIGURES

Other characteristics and advantages of the present invention will emerge from the following description, in reference to the attached figures which illustrate an exemplary embodiment devoid of any limiting character, in which.

DETAILED DESCRIPTION OF AN EMBODIMENT

A slipcover 1 and a suitcase 7 according to the invention will now be described in a particular embodiment in reference conjointly to FIGS. 1 to 5.

Figure 1:
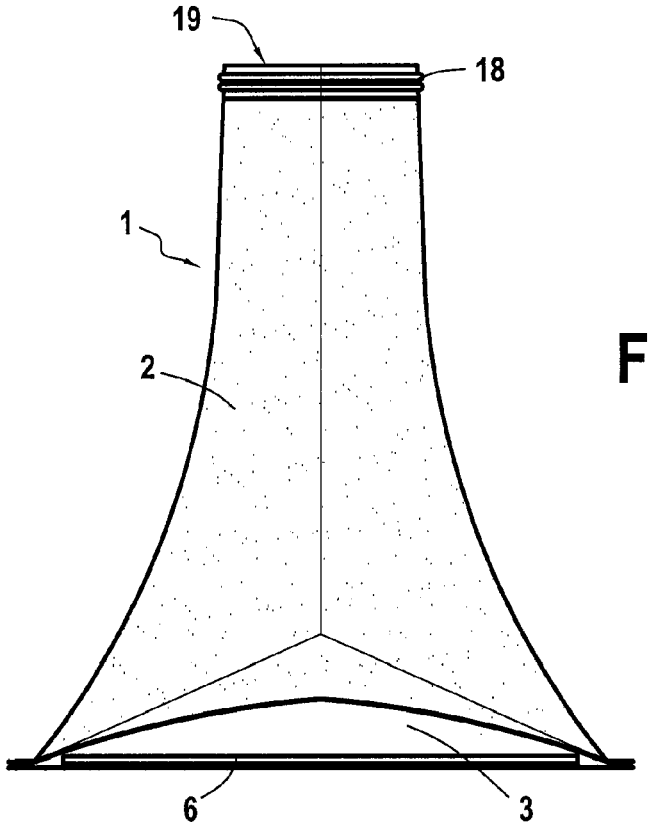
FIG. 1 schematically illustrates a side view of a slipcover according to a particular embodiment of the invention.
Figure 2:
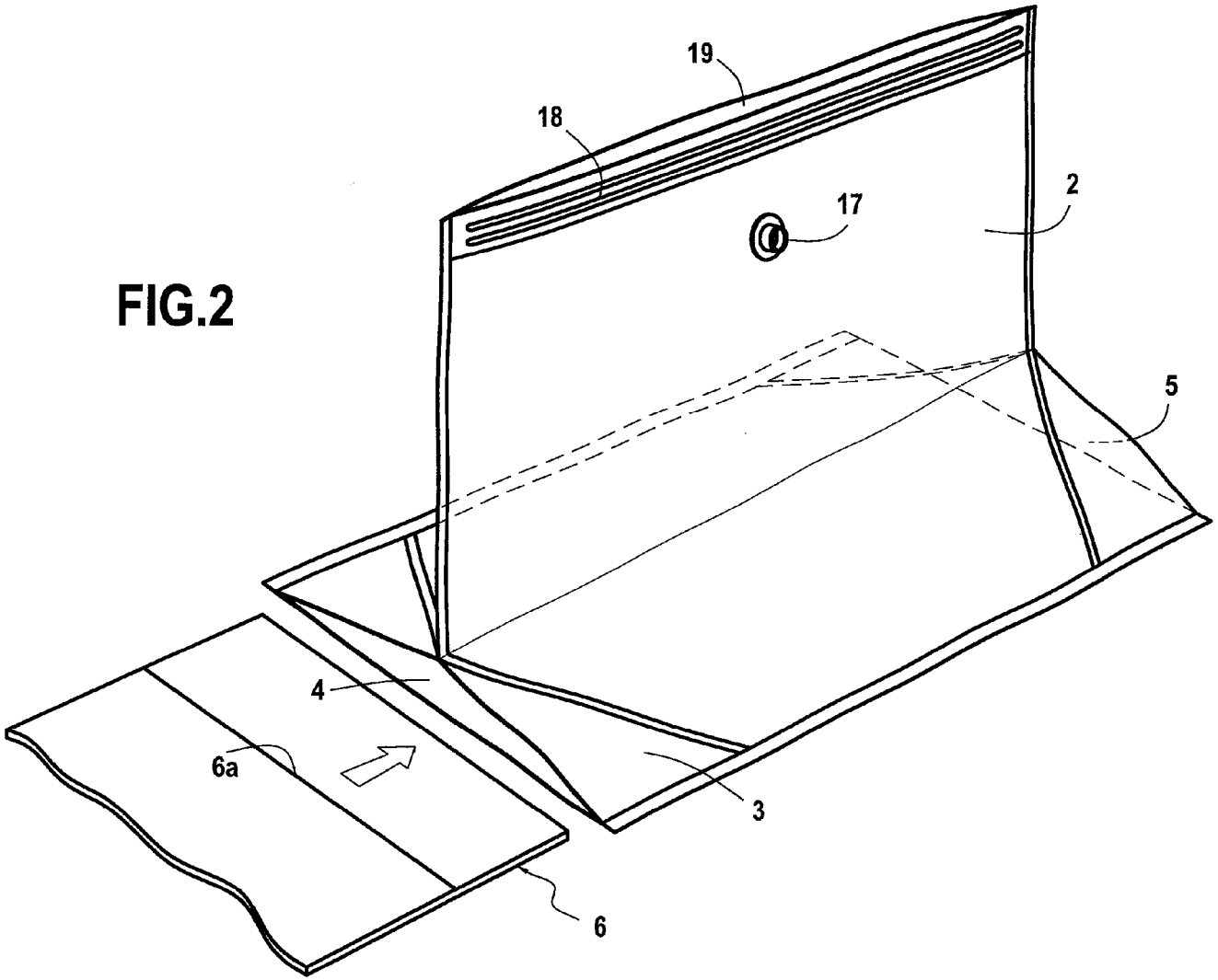
FIG. 2 schematically illustrates a perspective view of a slipcover according to a particular embodiment of the invention.

The slipcover 1 according to FIGS. 1 and 2 is constituted by a first envelope 2 which extends substantially vertically, and a second envelope 3 which is placed substantially perpendicularly to the lower end of the first envelope 2.

In the embodiment described here, the first envelope 2 comprises a valve 17 for extracting air contained in this envelope 2 to compress the slipcover. It should be noted that this valve can cooperate with any type of pump or fan.

The first envelope further comprises a zip system 18 which enables hermetic sealing of the first envelope 2.

Figure 4:
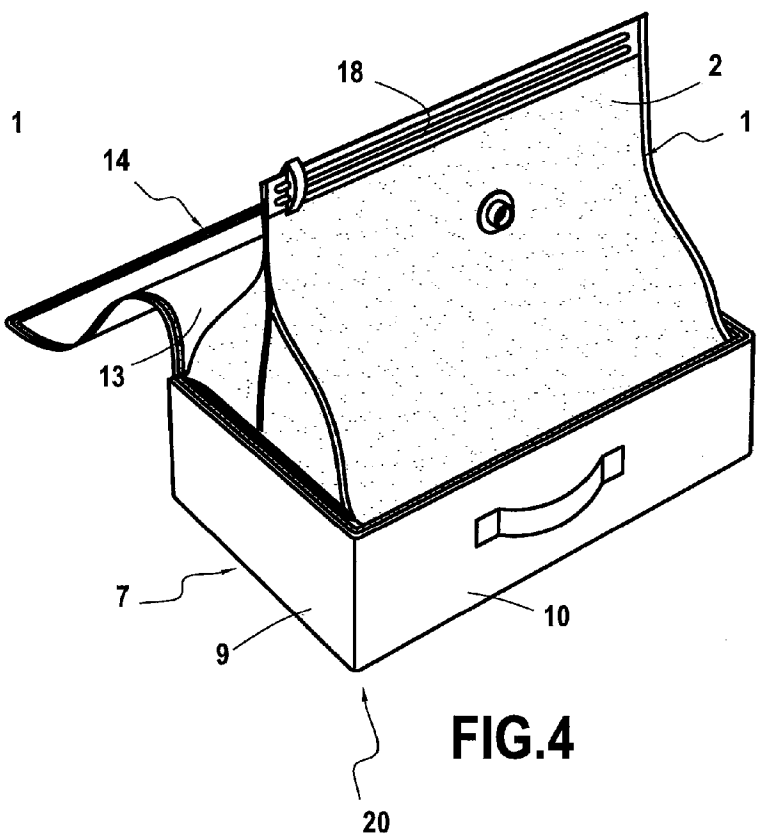
FIGS. 3 and 4 schematically illustrate a slipcover and a suitcase according to a particular embodiment of the invention.
Figure 3:
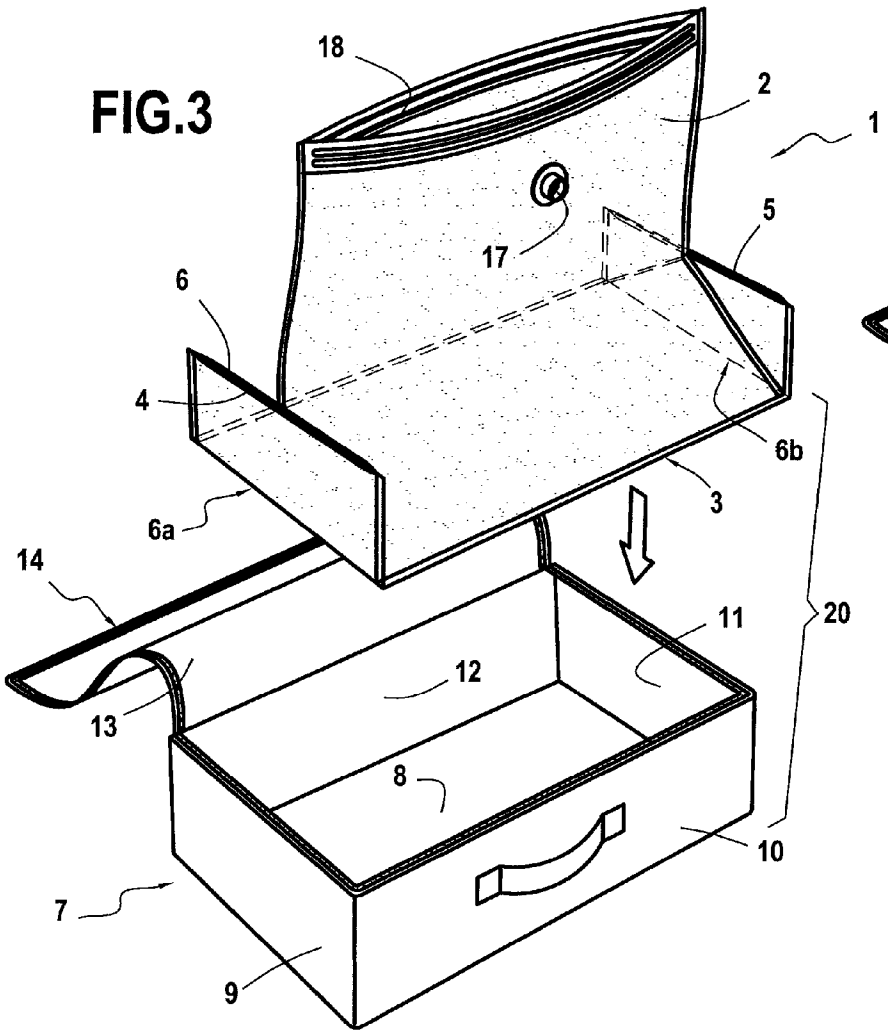

The suitcase 7 according to FIGS. 3 and 4 takes the form of a parallelepiped which has dimensions substantially bigger than those of the slipcover 1 in the compressed state. Typically, this suitcase 7 comprises a base 8, four side walls 9 to 12, as well as an upper part 13 which is fitted with an opening system 14 arranged between the peripheral edges of the upper part 13 and the upper end of the lateral walls 9 to 12.

Within the scope of transporting an article which can be compressed, the slipcover 1 and the suitcase 7 can prove to be highly advantageous.

With respect to the example of someone wanting to transport a duvet (very bulky textile article) and having a kit according to the invention, the kit comprises a storage slipcover 1, a suitcase 7 and a travel pump.

In a manner known per se, this person folds this duvet, and slips it into the slipcover 1 via the opening 19 located on the upper end of the first envelope 2.

So as to hermetically isolate the duvet located in the slipcover 1 from the rest of its environment, the person will slide the zip system 18 to a closed position.

Next, the person will utilise the valve 17 and the pump provided (not illustrated) with the kit to create a quasi-vacuum inside the first envelope 2.

This extraction of air allowed by the pump and the cooperation of the valve 17 and the zip system 18 will cause compression of the duvet, the volume of which will now diminish to present minimum bulk.

Obtaining a storage slipcover 1 having certain solidity especially at its ends is one of the objects of the present invention.

In this respect, the second envelope 3 has two openings 4 and 5 to allow introduction of a soft-board and more or less rigid plate 6 inside the latter. Other materials for the design of this plate 6 are feasible, of course, such as a plate made of rigid or semi-rigid plastic.

It is evident from FIGS. 2 and 3 that the plate 6 has folding means 6*a*, 6*b*.

Therefore, during compression of the duvet in the first envelope 2, the slipcover 1 deforms. The plate 6 and the second envelope 3 permit this deformation and fold according to these means 6*a*, 6*b* independently of one another to form a parallelepiped with dimensions substantially less than the dimensions of the suitcase 7.

It should be noted that due to the specific design of the present invention which avoids any fixing or assembly of the plate 6 with the second envelope 3, the ends of the slipcover 1 are solid, and will not be torn off at the level of a fixing point, as can be seen in the prior art.

In addition, once the duvet is inserted in the first envelope 2, and after the start of compressing this first envelope 2, it is still possible to conveniently reposition the plate 6 prior to being folded to form the parallelepiped base.

Thus, once the slipcover 1 has taken the form of a parallelepiped as illustrated in FIGS. 3 and 4, the user can place this slipcover 1 in the suitcase 7.

Figure 5:
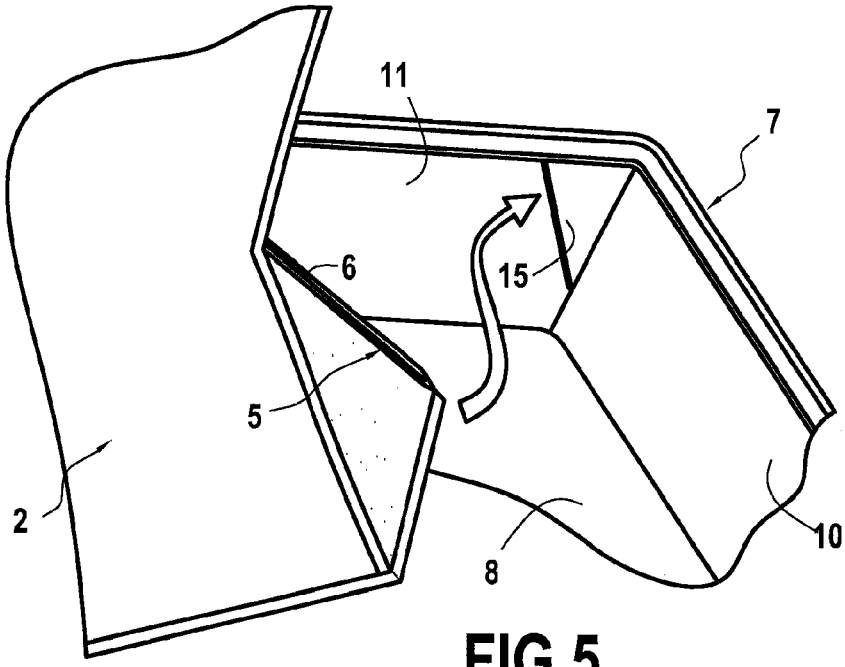
FIG. 5 schematically illustrates a view of the interior of the suitcase according to a particular embodiment of the invention.

As illustrated in FIG. 5, and to always prevent any tearing of the slipcover and to ensure its being kept in position in the suitcase 7, this suitcase 7 characteristically has reception means 15 for receiving the angular ends of the plate 6, then sealing and stabilising the slipcover 1 and its contents in the suitcase 7; its reception means 15 are located on the lateral sides of the vertical walls 9 to 12.

With the slipcover 1 wedged in the suitcase 7, the user can fold down the upper part 13 of the suitcase 7, then close it using the system 14.

Figure 7:
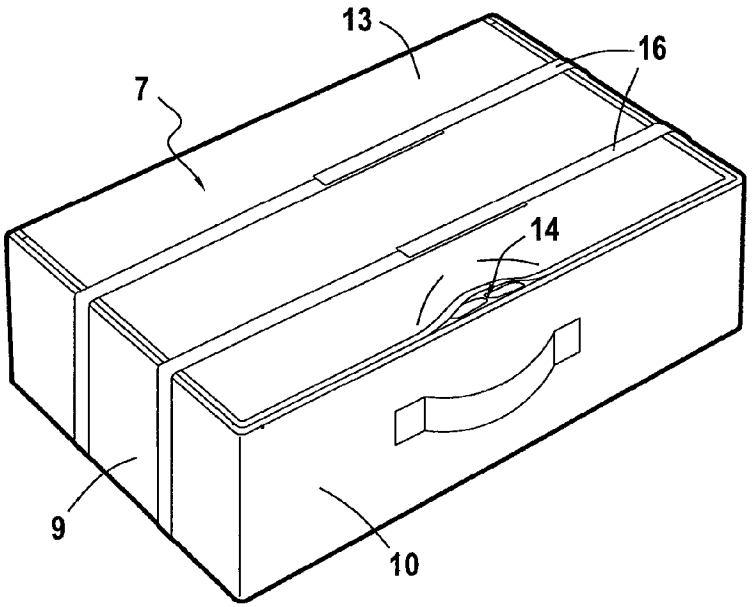
FIGS 6 and 7 schematically illustrate belt systems that can be used with a suitcase according to particular embodiments of the invention.
Figure 6:
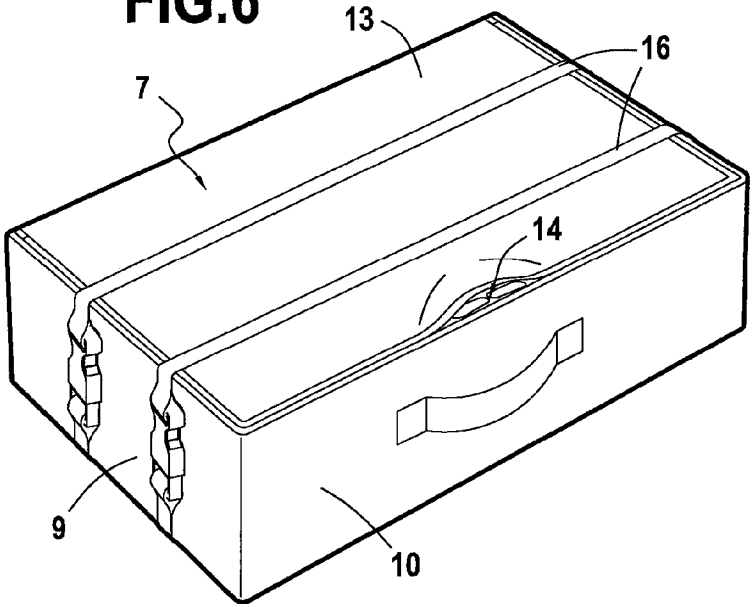

To prevent accidental opening during transport or mishandling, it is also preferable to use a belt system 16 which encompasses the suitcase, and is fixed by a clip-closing system, such as shown in FIG. 6, or by Velcro®, such as shown in FIG. 7.

In the embodiment described here, the slipcover and the suitcase are particularly adapted to the different constraints of storage and/or transport of bulky textile merchandise. It should however be understood that this exemplary embodiment as described apparently must not cover any character limiting the object of the invention.

The invention claimed is:

1. A storage slipcover for receiving articles, comprising a first envelope extending vertically and fitted at its upper end with an opening for insertion of said articles, and a plate fitted with folding means for the formation of a parallelepiped base in which is placed at least the lower part of the first envelope, said storage slipcover further comprising a second envelope fixed horizontally at the lower end of the first envelope so that the first and second envelopes form a single element, this second envelope comprising dimensions slightly greater than the plate and at least one opening for introducing this plate horizontally into said second envelope.

2. The slipcover according to claim 1, wherein the first envelope comprises at its upper end closing means of the opening for airtight sealing of the slipcover, wherein the closing means is a zipper.

3. The slipcover according to claim 1, wherein the first envelope comprises on one of its walls air extraction means for extracting air contained inside said first envelope, wherein the air extraction means is a valve.

4. The slipcover according to claim 1, wherein the lower part of the first envelope, the second envelope and the plate are plane rectangular in shape, the width of the plate being less than the width of the lower part of the first envelope and that of the second envelope, the length of the plate being also less than the length of the lower part of the first envelope and of that of the second envelope.

5. The slipcover according to claim 4, wherein the folding means comprises two folding lines extending transversally and separating said plate into a central part and two fold-down lateral parts for the formation of the parallelepiped base.

6. The slipcover according to claim 4, wherein the second envelope comprises two lateral ends each fitted with an opening for insertion of the plate.

7. The slipcover according to claim 5, wherein the two fold-down lateral parts are of identical length and of such a size that the volume of the parallelepiped base corresponds to the volume of the first envelope once the air is extracted.

8. The storage slipcover according to claim 1, wherein the at least one opening of the second envelope is two openings, the openings being located at opposite ends of the second envelope.

9. A bag for storage and/or transport of articles, comprising a suitcase, wherein the bag is equipped with a storage slipcover for receiving articles, the storage slip cover comprising a first envelope extending vertically and fitted at its upper end with an opening for insertion of said articles, and a plate fitted with folding means for the formation of a parallelepiped base in which is placed at least the lower part of the first envelope, said storage slipcover further comprising a second envelope fixed horizontally at the lower end of the first envelope so that the first and second envelopes form a single element, the second envelope comprising dimensions slightly greater than the plate and at least one opening for introducing this plate horizontally into said second envelope, said slipcover being suitable to be enclosed in said suitcase.

10. The bag according to claim 9, wherein the suitcase comprises a peripheral vertical wall, and wherein this wall comprises on its internal face reception means for receiving the parallelepiped base for the purpose of stabilising the slipcover in the suitcase.

11. A bag for storage and/or transport of articles, comprising a suitcase, wherein the bag is equipped with a storage slipcover for at least one article, such as a textile article, comprising a first envelope extending vertically and fitted at its upper end with an opening for insertion of said at least one article, and a plate fitted with folding means for the formation of a parallelepiped base in which is placed at least the lower part of the first envelope, said storage slipcover further comprising a second envelope assembled horizontally below the lower end of the first envelope, this second envelope comprising dimensions slightly greater than the plate and at least one opening for introducing this plate into said second envelope, said slipcover being suitable to be enclosed in said suitcase, and wherein said suitcase comprises a peripheral vertical wall, and this wall comprises on its internal face reception means for receiving the parallelepiped base for the purpose of stabilising the slipcover in the suitcase, and wherein the peripheral vertical wall comprises at least two lateral sides, said bag comprising a storage slipcover according to claim 5, wherein the reception means are constituted by rebates located at the level of the upper angular ends of said at least two lateral sides, said rebates enabling reception of the angular ends of the lateral parts, which can be folded down, of the plate during formation of the parallelepiped base.

12. A kit comprising a bag for storage and/or transport of articles, comprising a suitcase, wherein the bag is equipped with a storage slipcover for at least one article, such as a textile article, comprising a first envelope extending vertically and fitted at its upper end with an opening for insertion of said at least one article, and a plate fitted with folding means for the formation of a parallelepiped base in which is placed at least the lower part of the first envelope, said storage slipcover further comprising a second envelope assembled horizontally below the lower end of the first envelope, this second envelope comprising dimensions slightly greater than the plate and at least one opening for introducing this plate into said second envelope, said slipcover being suitable to be enclosed in said suitcase, wherein the first envelope comprises on one of its walls air extraction means, of valve type, for extracting air contained inside said first envelope, and wherein said kit also comprises a pumping apparatus for extraction of air in said slipcover.

13. The kit according to claim 12, wherein the lower part of the first envelope, the second envelope and the plate are plane rectangular in shape, the width of the plate being less than the width of the lower part of the first envelope and that of the second envelope, the length of the plate being also less than the length of the lower part of the first envelope and of that of the second envelope.

14. The kit according to claim 13, wherein the folding means comprises two folding lines extending transversally and separating said plate into a central part and two fold-down lateral parts for the formation of the parallelepiped base.

15. The kit according to claim 13, wherein the second envelope comprises two lateral ends each fitted with an opening for insertion of the plate.

16. The kit according to claim 14, wherein the two fold-down lateral parts are of identical length and of such a size that the volume of the parallelepiped base corresponds to the volume of the first envelope once the air is extracted.

* * * * *